US005947395A

United States Patent [19]

Peterson et al.

[11] Patent Number: 5,947,395

[45] Date of Patent: Sep. 7, 1999

[54] MATERIALS REDUCING MACHINE

[75] Inventors: Arnold N. Peterson, Eugene; Larry A. Sprague, Pleasant Hill, both of Oreg.

[73] Assignee: Peterson Pacific Corp., Eugene, Oreg.

[21] Appl. No.: 08/935,225

[22] Filed: Sep. 22, 1997

[51] Int. Cl.[6] ..... B02C 18/22

[52] U.S. Cl. ..... 241/32; 241/73; 241/223; 241/242; 241/225

[58] Field of Search ..... 241/225, 223, 241/222, 242, 280, 73, 88.4, 85.3, 186.35, 32

[56] References Cited

U.S. PATENT DOCUMENTS

Re. 17,120 10/1928 Keith .
953,111 3/1910 Williams ..... 241/225
1,776,593 9/1930 Meyer .
1,816,097 7/1931 Sumner .
4,773,601 9/1988 Urich .
5,265,811 11/1993 Willibald .
5,417,375 5/1995 Peterson .
5,472,146 12/1995 Doppstadt .

*Primary Examiner*—Mark Rosenbaum
*Attorney, Agent, or Firm*—Robert L. Harrington

[57] ABSTRACT

A machine for reducing materials such as logs, limbs, stumps and the like into small particles. A hold down and infeed roller in combination with a conveyor feeds the materials into a rotating rotor. The rotor has cutters mounted on its periphery and is rotated in a direction to produce an upward cutting action. The rotor partially reduces the materials into smaller particles. An anvil in combination with the rotor further reduces the particles into the desired size. A grate dictates the size of the materials to be discharged from the machine.

6 Claims, 2 Drawing Sheets

MATERIALS REDUCING MACHINE

FIELD OF THE INVENTION

A machine that reduces materials, i.e., converts a variety of materials of different sizes to smaller pieces convenient, e.g., for handling and recycling purposes and particularly it relates to a machine having improved feeding of such materials into a materials reducing rotor.

BACKGROUND OF THE INVENTION

Materials reducing machines of the type herein contemplated receive large materials, e.g., logs, tree stumps and materials for recycling. Typically a large rotor containing knives or teeth on its peripheral surface area is rotated so as to strike the incoming material in a downward arcing path against an anvil at the end of the conveyor that produces a shearing action of the materials. A continuous pushing force is required to literally push the materials into the rotor teeth.

A conveyor is generally not sufficient as a pushing force and the force applied is typically provided by a piston or ram that has to be cycled. Also, whereas a discharge conveyor underlies the rotor, opportunity to screen is limited to a short duration between where the material is first struck by the rotor teeth and where the reduced material is discharged onto the discharge conveyor.

BRIEF DESCRIPTION OF THE INVENTION

The idea of reversing the rotor, i.e., to strike the material in an upward arc, would appear to cause many difficulties and no advantages. The present invention provides just such a reversal of the rotor with significant advantage. A crusher/infeed roller precedes the reducing roller and its weight presses the material downward sufficient to enable the upwardly directed cutting teeth to substantially impact and reduce the materials. The crusher/infeed roller is mounted on a pivoting arm that is pivotally mounted above the rotor. The arm is arranged to form a chute for the material following the initial impact and confines the material close to the periphery of the rotor. The teeth, following impact, engage and propel the material up and over the rotor and then against an anvil where the teeth of the rotor shear the materials to substantially complete the reduction. The teeth of the rotor accordingly provide the functions of impact cutting, propulsion and shear cutting of the materials.

The roller rotates faster than the conveyor to accelerate feeding of the material at the point of entry and the rotor is rotated at an exceptionally high rate of speed, e.g., 1,100–1,200 rpms for effective impact cutting and rapid conveyance of the material through the reduction apparatus. The crusher roller is provided with substantial weight to facilitate the impact cutting and to confine the material to the rotor for conveyance into the shear cutting station. The resultant two-stage reduction produces more efficient cutting than the single shear cutting of conventional reducing machines. A grate is further provided to size the reduced material and to the extent that the material needs to be further reduced, the rigid cross bars of the grate in combination with the rotor teeth accomplish a third stage of reduction.

In a prior art device, U.S. Pat. No. 5,265,811, certain features not typical of conventional reducers, have similarities to the present invention. A rotor with rigid flailing teeth rotates upwardly to carry material through counter cutting edges. Impact cutting is not suggested and the device relies on a separate cutting rotor for precominuting. A chute is provided but separate from the supporting arm of a crusher roller.

The invention will be further understood and appreciated upon reference to the following detailed description and accompanying drawings.

DESCRIPTION OF THE PREFERRED EMBODIMENT

Figure 1:
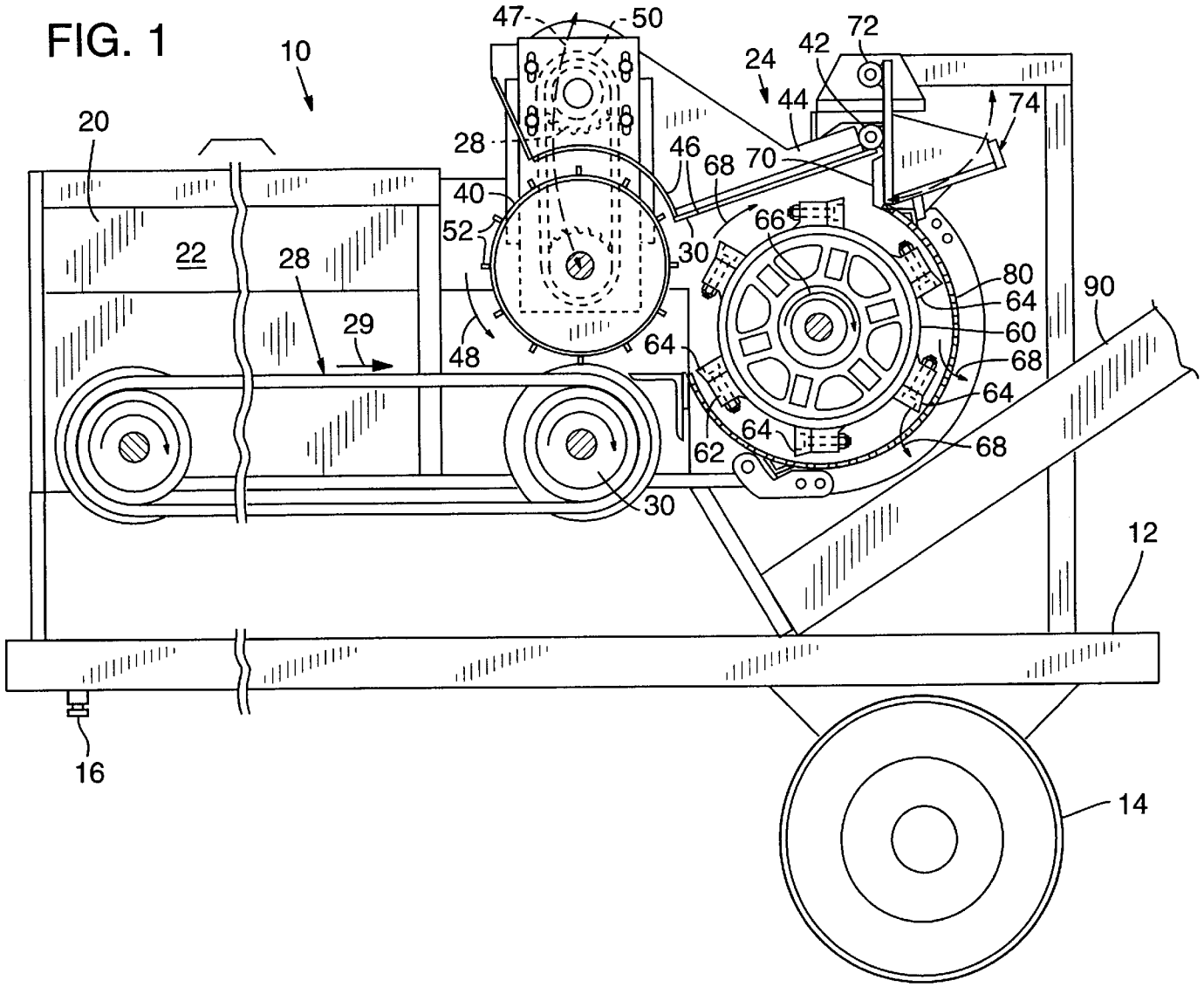
FIG. 1 is a side elevation view of a material reducing machine.

FIG. 1 illustrates a material reducing machine 10 that is arranged to reduce materials such as logs, tree stumps, tree limbs and the like into small particles. In this embodiment, the machine 10 includes a chassis 12 for portability with the chassis 12 having wheels 14 for transport. The chassis 12 has a conventional hitch 16 for connection to a conventional towing unit. The machine 10 thus may be transported to a site where materials to be reduced have been accumulated.

The machine 10 has a receiving bin 20 for the deposit of materials that are to be reduced. The bin 20 has upstanding sides 22 for containment of the material that is deposited therein. A known conveyor 28 such as a belt-type conveyor extends along the bin 20 and is provided to convey the materials deposited in the bin 20 into a material reducing rotor 60 positioned at one end of the bin. The conveyor 28 conveys the materials in the direction indicated by arrow 29.

A hold down and infeed roller 40, hereafter referred to as a roller 40 is positioned at the exit end of the conveyor 28 immediately preceding the rotor 60 as illustrated. The roller 40 is provided in part to compact or crush the material and to assist the conveyor 28 in propelling the material into the rotational path of the rotor 60. The materials fed into the rotor 60 are partially reduced by impact cutting when initially engaged by cutters 64 mounted on the rotor. Additionally, an anvil 70 positioned strategic to the cutters 64 of the rotor 60 further reduces the particles by a shearing action as will be explained.

A sizing device such as a screen or grate 80 is provided following the shear cutting action to allow only material up to a specified size to pass through the grate. The material that has been reduced to or less than the specific size passes through the grate 80 and is deposited on an out feed conveyor 90. (The grate itself in combination with the rotor teeth will produce additional reduction as will be explained.) The conveyor 90 conveys the screened material to a container or onto a pile. Conventional power sources (not shown) provide the motive power for the conveyor and rotor of the machine 10.

Figure 2:
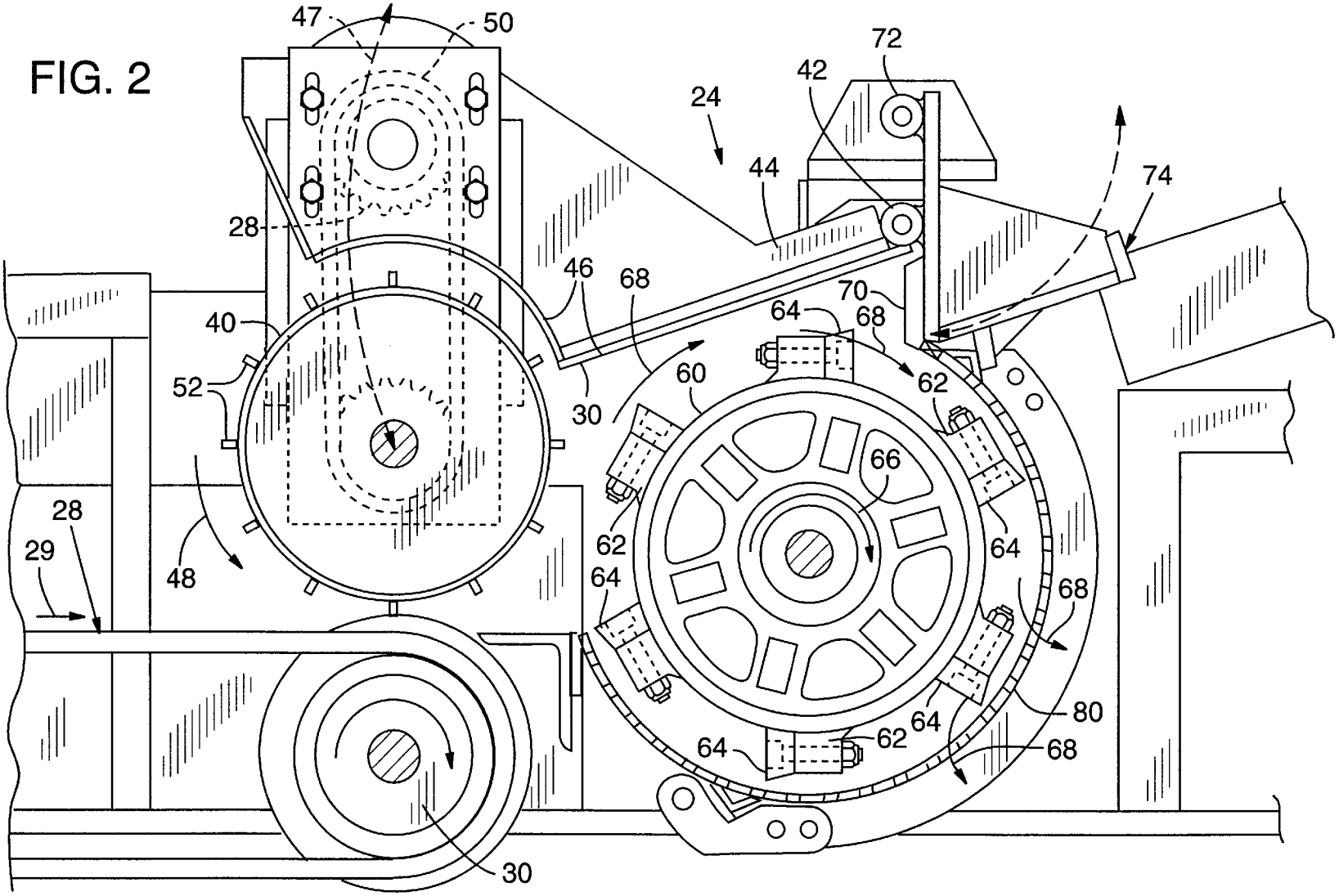
FIG. 2 is a view of an enlarged portion of the reducing machine of FIG. 1.

Refer now to the enlarged view of FIG. 2 of the drawings. As previously mentioned, the conveyor 28 extends along the length of the bin 20 and is provided to convey the material that is deposited into the bin 20 toward and into the rotational path of the rotor 60 indicated by arrow 29. The roller 40 is positioned adjacent to the exit end of the conveyor 28. The roller 40 is pivotally mounted on arms 44 with the pivot point designated as 42. The roller 40 is thus pivotally movable toward and away from the exit end of the conveyor 28 which also defines the point of infeed to the rotor. In this embodiment, the pivot point 42 or pivot axis of the roller 40 is positioned above and rearward of the rotational axis of the rotor 60 in the vicinity of the 1 o'clock position. The pivotal movement of the roller 40 is indicated by arrow 47.

A shroud 46 is provided by the configuration of arms 44 and functions as a chute or pathway for the particles of material propelled by engagement of the upwardly directed teeth 64 of rotor 60. The roller 40, its drive mechanism 50 and the shroud 46 are all mounted on the arms 44 to provide sufficient weight to act as a biasing force or hold down force. Lugs 52 provide the gripping action to propel the material as the roller rotates. The weight and rotation of the roller 40 and its related components mounted on the arms 44 force material under the roller and then crushes/compacts the materials between the roller 40 and the conveyor 28 as it is fed to the rotor. The roller 40 is rotated at a rate such that its peripheral speed is substantially greater than the travel rate of the conveyor 28. Thus material that may be piled high in the bin, e.g., tree branches, is pushed down and through the entry of the rotor at a more rapid rate than the conveyor speed. This inhibits congestion as long as the material is rapidly swept clear of the entry, accomplished by the rotor rotating at a further increased speed, e.g., 1,000–1,200 rpms.

The rotor 60 has on its periphery at spaced intervals, cutter support blocks 62 that support the replaceable cutters or teeth 64. The cutters 64 as the rotor 60, due to the rotor being rotated at a high rate of speed, impacts and chips away the materials that are being conveyed into the rotor 60 by the roller 40 and the infeed conveyor 28. The rotor 60 is rotated in the direction indicated by arrow 66 with the rotor 60 being driven by the drive mechanism. As explained, because the rotor 60 is rotatably driven at a much higher rate than the infeed roller 40, the cutters 64 effectively reduce the materials by impact cutting. The particles thus reduced by the cutters 64 of the rotor 60 will be propelled along the pathway defined by the chute 46. The anvils 70, which are in the travel path, will in combination with the cutters 64 further reduce the particles through shear cutting action.

The anvils 70 are pivotally mounted on a shaft 72. Anvils 70 are, however, retained in a fixed position by shear pins 74. The shear pins 74 will shear or break when the anvil 70 is struck by a large or hard material that is not shearable by the cutter 64 and the anvil 70. This is a safety feature to prevent jamming or damage to the rotor 60 and the anvil 70. The cutters 64 and the anvils 70 in combination will typically shear the material that has been initially partially reduced through impact by the cutters 64 to further reduce the material to a size that will pass through the grate 80.

The grate 80 including a cross pattern of rigid cross bars and defining openings there through, is mounted adjacent to the anvil 70 and receives the material as it is reduced by the shearing action. The material that is substantially reduced but still too large to readily pass through the grate 80 will be forced by the rotor teeth against the cross bars of the grate (located in close proximity to the rotor teeth) which functions like many anvils to further break up the material typically to a size that will pass through the openings. As will be noted from FIG. 1, the grate extends from the anvil 70 around the periphery of the rotor to the position of infeed. Material passing through the grate 80 at any point between the anvil and infeed is deposited on the out feed conveyor 90 and the conveyor 90 will transport the sized material to a container or simply deposit the material on the ground.

The upward cutting action of the cutters 64 of the rotor 60 provides a flow pattern that is beneficial to discharging the reduced material through the grate 80. The cutters 64 as they impact and then sever the material being fed by the conveyor 28 and roller 40 will be propelled upwardly along the pathway defined by the shroud or chute 46 and thus essentially will be flowing in an air stream to the grate 80.

Those skilled in the art will recognize that modifications and variations may be made without departing from the true spirit and scope of the invention. The invention is therefore not to be limited to the embodiments described and illustrated but is to be determined from the appended claims.

We claim:

1. A materials reducing machine comprising:

a materials receiving bin, a materials reducing rotor mounted in the bin at one end and a conveyor conveying material received in the bin into the rotor and the improvement which comprises;

said rotor having rigidly mounted cutters on its periphery and said rotor rotating in a direction to cause impacting of the cutters against material being fed to it in an upwardly arcing direction for partial reduction of the material;

a driven hold down and infeed roller positioned to engage the material prior to the material being fed into the rotor;

said roller carried by a pivotal arm extended rearwardly and upwardly to a pivot positioned above the rotor, said roller and arm provided with a determined downwardly directed force to crush the material and resist upward movement of the material as the material is impacted by the cutters for reduction of the material, and a chute provided on said arm and movable with said arm for directing the material impacted and carried by the rotor teeth; and an anvil adjacent to the path of the teeth and in relation to the chute whereby material carried by the teeth and directed by the chute is fed into the anvil whereat the teeth and anvil in combination further reduce the material by shearing action.

2. A materials reducing machine as defined in claim 1 wherein the hold down and infeed roller is weighted to provide the downwardly directed force and the crushing action of the material being fed to the rotor, said roller and rotor rotatively engaging the material at a rate greater than the conveyor speed.

3. A materials reducing machine as defined in claim 2 wherein the weight of the roller is enhanced by a drive mechanism rotatively driving the roller and carried by the arm.

4. A materials reducing machine as defined in claim 1 wherein the anvil is fixedly mounted relative to the path of the teeth by a shear pin that shears when subjected to a determined excessive shearing force.

5. A materials reducing machine comprising:

a materials receiving bin, a materials reducing rotor mounted in the bin at one end and a conveyor conveying material received in the bin into the rotor and the improvement which comprises;

said rotor having rigidly mounted cutters on its periphery and said rotor rotating in a direction to cause impacting of the cutters against material being fed to it in an upwardly arcing direction for partial reduction of the material;

a driven hold down and infeed roller positioned to engage the material prior to the material being fed into the rotor and to force the material downwardly and inwardly of the roller as an aid to feeding of the material into the rotor for impact engagement by said cutters and first reduction of the material;

an anvil adjacent to the path of the teeth, and a chute mounted for directing material along the path of the teeth and toward the anvil whereby material carried by the cutters and directed by the chute is fed into the anvil with the cutter teeth moving in a laterally directed arc at the top of the rotor whereat the cutters and anvil in combination further reduce the material by shearing action; and a screening member provided with screen openings, said screen member receiving the materials following the shear action at the anvil and extending adjacent the cutters along the entire downwardly directed arc path of the cutters and in cooperation with said rotor cutters further reducing the material as required to fit through the screen openings, and a discharge conveyor underlying said screen for receiving materials passing through the screen opening.

6. A materials reducing machine as defined in claim 5 wherein the anvil provides a cutting edge spaced to permit close passing of the cutters under the anvil whereby materials carried by the cutters and extended outwardly of the cutters are caught in a shearing action between the cutters and the anvil, said anvil forcing the material under the anvil and between the cutters.

* * * * *